United States Patent [19]

Arthur

[11] Patent Number: 4,522,530

[45] Date of Patent: Jun. 11, 1985

[54] SELF-ERECTING ROADWAY MARKING POST

[76] Inventor: W. Eugene Arthur, 1930 Winton Ave., Bldg. 11, Hayward, Calif. 94545

[21] Appl. No.: 448,298

[22] Filed: Dec. 9, 1982

[51] Int. Cl.[3] ..... E01F 9/01

[52] U.S. Cl. ..... 404/10; 40/608; 52/155

[58] Field of Search ..... 404/10, 11, 15, 16; 256/1, 13.1, DIG. 2, DIG. 5; 248/156, 548; 40/608, 612; 116/63 R; 52/155

[56] References Cited

U.S. PATENT DOCUMENTS

| | | | |
|---|---|---|---|
| 1,153,450 | 9/1915 | Schaff | 52/155 |
| 1,268,167 | 6/1918 | Shoecraft | 248/156 |
| 1,334,812 | 3/1920 | Snow | 256/DIG. 5 |
| 1,366,872 | 1/1921 | Cantleberry | 248/156 X |
| 2,580,948 | 1/1952 | Pancake | 248/156 X |
| 2,945,659 | 7/1960 | McDonald | 248/156 X |
| 3,212,415 | 10/1965 | Byrd | 404/10 |
| 3,279,133 | 10/1966 | De Korte | 404/10 X |
| 3,552,698 | 1/1971 | Kinney | 404/10 X |
| 3,606,222 | 9/1971 | Howard | 248/156 X |
| 3,823,785 | 7/1974 | Toliver | 248/156 X |
| 3,843,079 | 10/1974 | Reisling | 248/156 X |
| 3,851,615 | 12/1974 | Thorvaldsen | 404/9 X |
| 3,902,818 | 9/1975 | Boone | 404/10 |
| 4,084,914 | 4/1978 | Humphrey et al. | 404/10 |
| 4,092,081 | 5/1978 | Schmanski | 404/10 |
| 4,106,879 | 8/1978 | Diedershagen et al. | 404/10 |
| 4,123,183 | 10/1978 | Ryan | 404/10 |
| 4,269,534 | 5/1981 | Ryan | 404/10 |
| 4,343,567 | 8/1982 | Sarver | 404/10 |

FOREIGN PATENT DOCUMENTS

| | | | |
|---|---|---|---|
| 2309249 | 8/1974 | Fed. Rep. of Germany | 404/10 |
| 204653 | 12/1965 | Sweden | 404/10 |
| 402923 | 5/1966 | Switzerland | 404/10 |

*Primary Examiner*—Stephen J. Novosad
*Assistant Examiner*—Beverly E. Hjorth
*Attorney, Agent, or Firm*—Jacox & Meckstroth

[57] ABSTRACT

An elongated flexible tube of resilient plastics material includes an upper end portion and a lower end portion and is capable of being repetitively bent through an angle of ninety degrees and of returning to an upright straight position with the aid of a flexible erecting member within the tube. The upper end portion may be thermally flattened for receiving a panel of reflective material or the reflective material may wrap around the tube. In one embodiment, the lower end portion of the tube projects into a hole within the ground and carries outwardly projecting spring fingers which positively lock into the ground. In another embodiment, a molded plastic base member releasably retains the lower end portion of the tube and is adapted to be cemented to a roadway surface. Also disclosed is a tool for quickly forming a series of holes within the ground to receive the lower end portions of the tubes.

9 Claims, 7 Drawing Figures

SELF-ERECTING ROADWAY MARKING POST

BACKGROUND OF THE INVENTION

There have been a number of roadway or highway guide or marking posts which are constructed either of a flexible material or are spring biased in order to be self-erecting in the event the marking post is accidentally hit and bent by a motor vehicle which leaves the roadway. For example, U.S. Pat. Nos. 4,084,914, 4,092,081, 4,106,879 and 4,123,183 disclose various forms of self-erecting roadway marking posts.

In the design of such a marking post, it is highly desirable for the post to be constructed in a manner which provides for quick and simple installation. The post should also be able to withstand many dozens of impacts from the bumpers of high speed vehicles without damaging or destroying the post and without pulling the post out of the ground. The ease and speed of installation is particularly important in view of the large number of marking posts which are used along the highways and expressways and the fact that frequently the installation of marking posts is performed when the installer is exposed to substantial motor vehicle traffic.

For the same reasons, it is also sometimes desirable for a marking post to be designed for quick and convenient replacement in the event that the post is destroyed or is no longer usable. In addition, it is desirable for the post to be installed in a manner by which the post may not be easily damaged or removed by a person walking along the roadway. Roadway marking post should also carry a reflecting material which cannot be easily scraped from the post by the underneath surface of a motor vehicle hitting and passing over the post.

SUMMARY OF THE INVENTION

The present invention is directed to improved self-erecting posts adapted for marking a roadway and which provides all of the desirable features and advantages mentioned above and which are also adapted for economical construction. In accordance with one embodiment of the invention, these advantages are provided by a post which includes a tube extruded of a resilient plastics material and which is adapted to be repetitively bent through an angle of over 90°. The lower end portion of the tube carries a set of spring fingers which project outwardly from the tube to engage the ground surrounding a hole which receives the lower end portion of the tube. A resilient plastic tubular erecting member is inserted within the tube and cooperates to provide the post with numerous self-erections in response to vehicle impacts on the post.

In another embodiment, the tube has a lower end portion which is releasably locked within a hole formed within the center of a molded plastic base member adapted to be cemented by adhesive to a roadway surface. The upper end portion of the tube carries a light reflective sheet which may surround the tube or be attached to a flattened section of the tube, and a closure member covers the upper end of the tube. The invention also provides an improved tool which quickly forms a hole within the ground for receiving the lower end portion of the flexible tube.

Other features and advantages of the invention will be apparent from the following description, the accompanying drawings and the appended claims.

DESCRIPTION OF THE PREFERRED EMBODIMENTS

Figure 1:
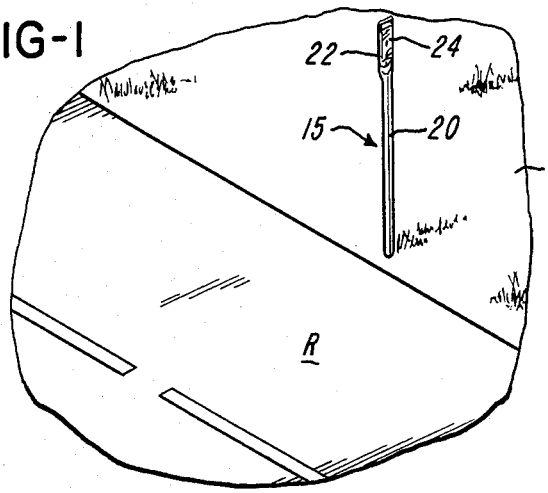
FIG. 1 is a perspective view of a self-erecting post constructed in accordance with the invention and illustrating its installation for marking a roadway.

FIG. 1 illustrates a self-erecting roadway marking post 15 which is adapted to be inserted into the ground G adjacent a roadway R. The marking post 15 includes an elongated cylindrical marking member or tube 20 which is extruded from a plastics material adapted to withstand a wide range of temperatures, such as a high density polyethylene or a polyester elastomer material, for example, as sold by duPont de Nemours under their trademark HYTREL. The tube 20 is capable of being flexed or bent many times through an angle of approximately 90° and being returned to a straight normal condition without causing any significant damage to the tube. The length of the tube 20 depends on the form of roadway marking or the use of the post and may extend, for example, from 18 inches to 48 inches.

Figure 2:
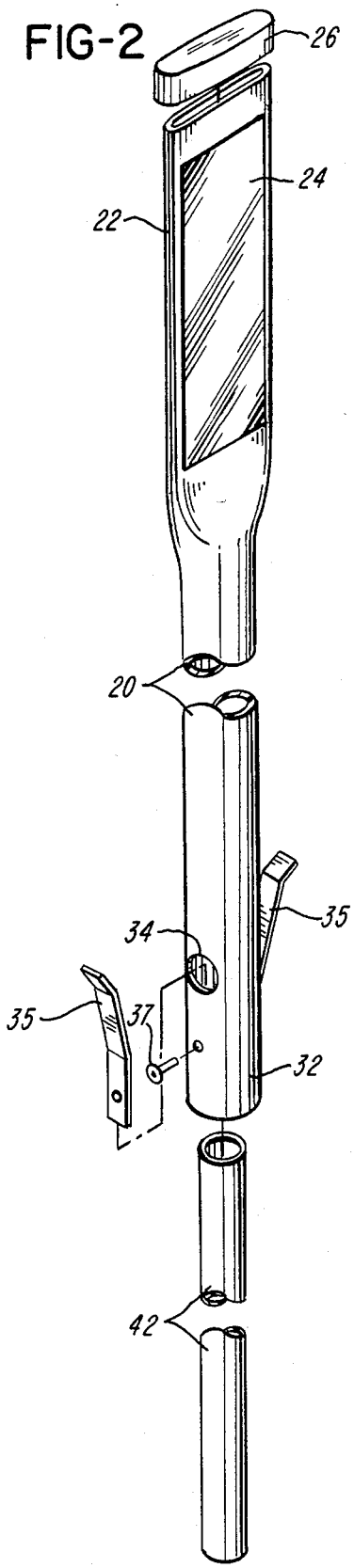
FIG. 2 is an exploded perspective view of the components which form the post shown in FIG. 1.

Referring to FIG. 2, the tube 20 has a flattened upper end portion 22 which is formed by first heating the end portion of the tube to a temperature of approximately 170° F., pressing the end portion flat between platens and then cooling the end portion with water at a temperature of about 40° F. A rectangular panel or sheet 24 of light reflecting material is attached by adhesive to one side of the flattened upper end portion 22 of the tube 20. One form of reflective sheet material which has proven satisfactory is a polycarbonate reflective sheet material manufactured by Reflexite Corporation in Bridgeport, Conn. The upper end of the tube 20 is covered by an oval-shaped closure member or cap 26 which is pressed onto the upper flattened end portion of the tube and secured by a suitable adhesive.

Figure 3:
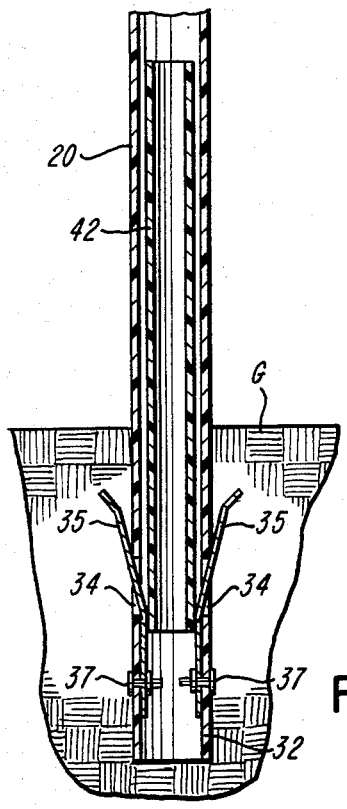
FIG. 3 is a vertical section of the lower portion of the post shown in FIGS. 1 and 2 and illustrating its installation within the ground.

Referring to FIGS. 2 and 3, the tube 20 has a lower end portion 32 which is adapted to be inserted into a hole formed within the ground G or within an asphalt roadway or roadway bed. The lower end portion 32 has a pair of diametrically opposed holes 34 through which project the upper end portions of a corresponding pair of ground engaging spring members or fingers 35. The fingers 35 are formed from a strip of spring sheet metal, and the lower end portions of the fingers 35 are secured by rivets 37 to the inner surface of the tube 20. After a cylindrical hole is formed within the ground, as will be explained later, the lower end portion of the tube 20 is pressed downwardly into the hole, and the spring fingers 35 press outwardly into the ground or road bed.

Since the tube 20 is resilient, the opposite sides of the tube 20 can deform inwardly by a slight amount when an inward pressure is inserted on the fingers 35 as the lower end portion of the tube 20 is forced into the hole.

As shown in FIGS. 2 and 3, a tubular erecting member or tube 42 extends within the outer tube 20 so that a center or intermediate portion of the tube 42 is located at the surface of the ground G or roadway. The erecting tube 42 is also extruded from a resilient plastics material such as low density polyethylene and is adapted to bend with the surrounding tube 20 when the post 15 is inadvertently hit or impacted by a motor vehicle. The erecting member or tube 42 cooperates with the outer tube 20 to prevent the outer tube from completely collapsing or kinking and to provide for self-erection of the post 15. The lower end portion of the inner erecting tube 42 engages the inner surfaces of the spring fingers 35 and aids in urging the fingers 35 outwardly into the ground when the lower end portion of the tube 20 is pressed into the hole within the ground.

Figure 4:
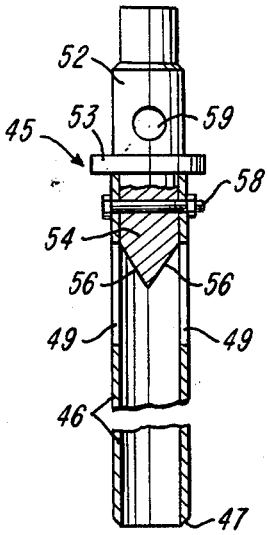
FIG. 4 is an elevational view, in part section of a tool for forming a hole within the ground for receiving the post.
Figure 5:
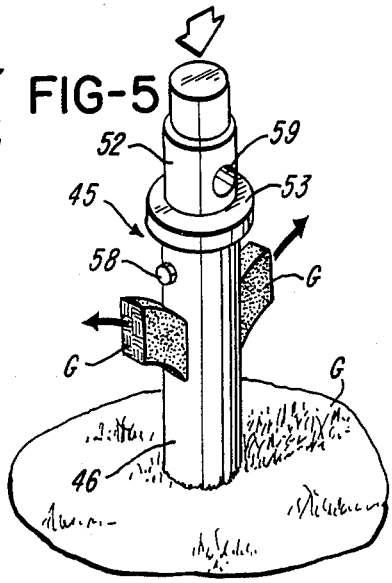
FIG. 5 is a perspective view of the tool shown in FIG. 4 and illustrating the tool in use.

Referring to FIGS. 4 and 5, a tool 45 is constructed for conveniently and quickly forming a hole within the ground or roadbed to receive the lower end portion of the tube 20. The tool 45 includes a hole cutting steel tube section 46 which has a frusto-conical lower end surface 47 to form a circular cutting edge. A pair of diametrically opposed rectangular openings or ports 49 are formed within the upper end portion of the tube section 46. The tool 45 also includes a metal or steel head member or section 52 which has an outwardly projecting flange 53 engaging the upper end of the tube section 46. The head section 52 also includes a cylindrical portion 54 which projects downwardly into the upper end portion of the tube section 46 and has a V-shaped or wedge-like lower end surfaces 56 extending downwardly from the upper ends of the ports 59. A cross-bolt 58 secures the tube section 46 to the head section 52 and provides for quickly replacing one of the sections in the field if it should become damaged and not usable.

As apparent from FIG. 5, when the tool 45 is driven into the ground, for example, by a power operated jack hammer or manually by a sledge hammer, the earth is forced upwardly within the tube section 46. The earth is split by the wedge surfaces 56 which direct or cams the earth outwardly through the ports 49 so that the tool 45 may be repetitively and continuously used for quickly formed holes within the ground to the precise diameter of the lower end portion of the tube 20. A cross hole 59 is formed within the head section 52 of the tool 45 and is adapted to receive a cross-bar (not shown) or rod which is used to twist the tool 45 to help in removing it from the ground after the hole is formed.

Figure 6:
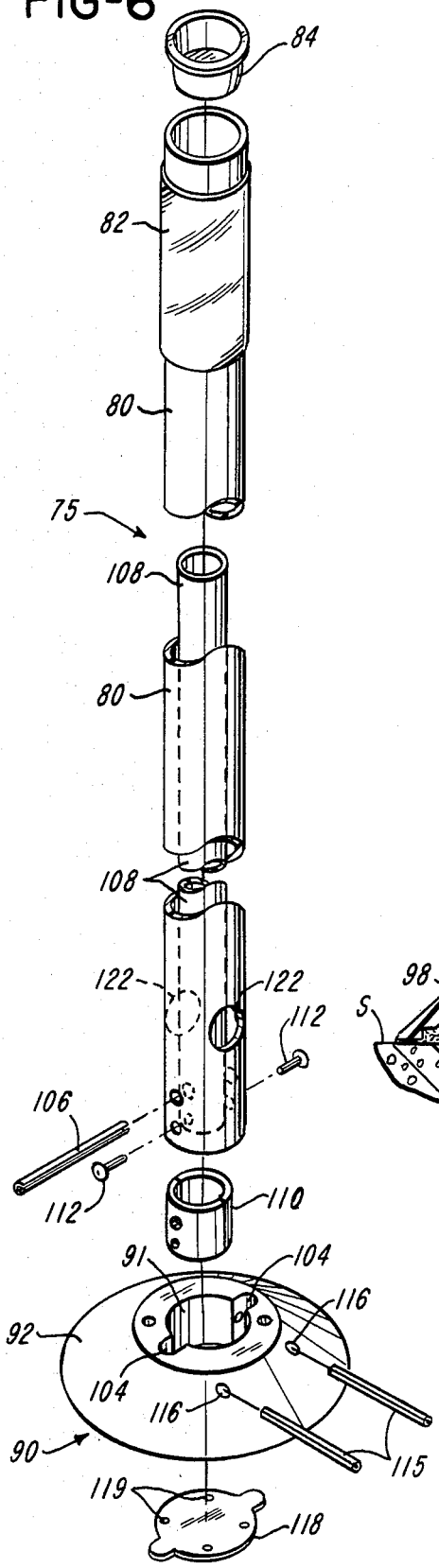
FIG. 6 is an exploded view similar to FIG. 2 and showing a modification of a post constructed in accordance with the invention.
Figure 7:
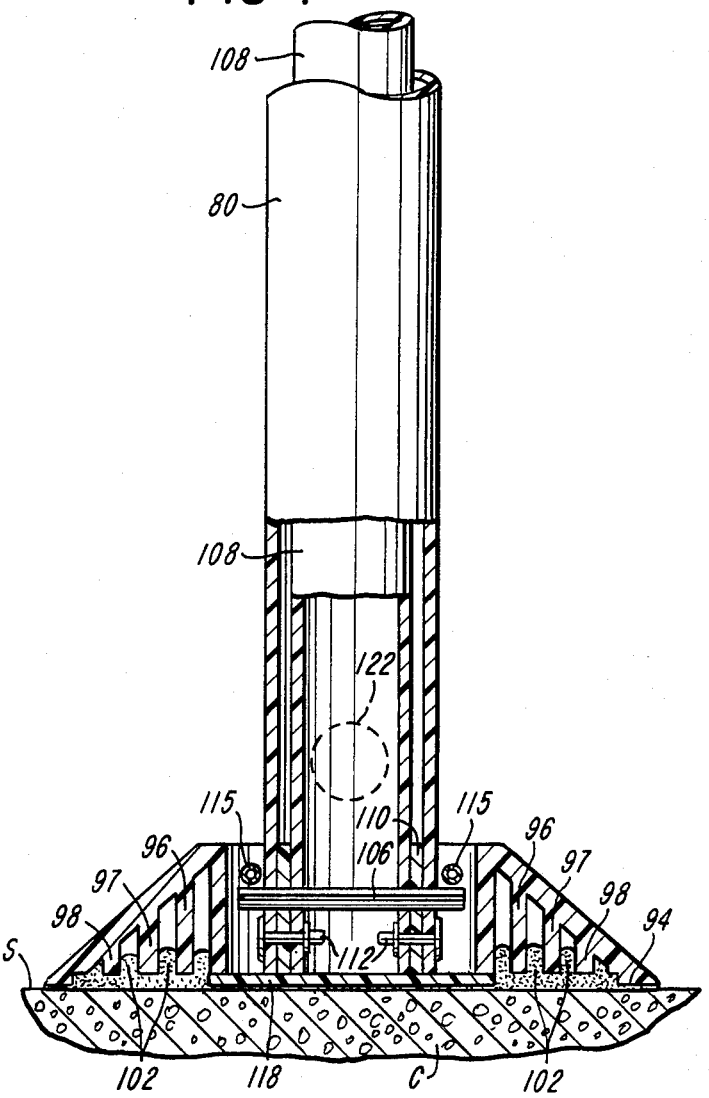
FIG. 7 is an enlarged fragmentary section of the lower end portion of the assembled post shown exploded in FIG. 6.

FIGS. 6 and 7 illustrate another embodiment of a self-erecting post 75 constructed in accordance with the invention and which includes an outer tube 80 constructed in the same manner as the tube 20 described above in connection with FIGS. 1–3. A sheet 82 of reflective material is adhesively bonded around the upper end portion of the tube 80, and a closure or plug member 84 closes the upper end of the tube 80 to prevent an accumulation of water and debris within the post. The upper end portion of the tube 80 may also be flattened to receive a rectangular sheet 24 of reflective material, as described above in connection with FIG. 2.

A base member 90 has a cylindrical center opening or hole 91 which receives the lower end portion of the tube 80 and has a tapered or frusto-conical outer surface 92. Preferrably, the base member 90 is molded of a rigid plastics material such as an ABS material. The outer edge portion of the base member 90 has a flat bottom surface 94, and a plurality of concentric ribs, 96, 97 and 98 are molded as an integral part of the base member 90. The ribs have bottom surfaces spaced slightly above the outer bottom surface 94. The base member 90 is adapted to be rigidly attached by a predetermined volume of adhesive 102 to a roadway surface S formed by a roadway of asphalt or concrete C. Preferrably, the adhesive 102 comprises an epoxy cement which extends upwardly between the ribs 96–98 and between the bottom surface 94 and the roadway surface S. By using sufficient adhesive 102 so that it extends between the ribs, a stronger bond is formed between the base member 90 and the roadway surface S.

As shown in FIG. 6, the hole 91 is interrupted by a pair of diametrically opposed vertical slots 104 which receive the outer end portions of a roll type cross-pin 106 extending through the lower end portion of the tube 80. The pin 106 also extends through the lower end portion of an inner self-erecting member or tube 108 which is extruded from the same plastics material as the erecting tube 42 described above in connection with FIG. 2. A cylindrical sleeve or spacer 110 is positioned between the erecting tube 108 and the surrounding tube 80 to maintain the tubes in concentric relation, and a pair of diametrically opposed rivets 112 secure the lower end portions of the tubes 80 and 108 with the spacer 110 confined therebetween to form a tube assembly.

After the lower end portion of the tube 80 is inserted into the hole 91 with the cross-pin 106 projecting into the slots 104, a pair of locking pins 115 are driven laterally through a corresponding pair of parallel spaced holes 116 within the base member 90. The holes 116 are located to position the locking pins 115 directly above the outer end portions of the cross pins 106, as shown in FIG. 7, so that the tube assembly is rigidly and positively locked or secured to the base member 90. If it is desired to remove the tube assembly from the base member 90 for replacement, the pins 115 are simply driven outwardly from the holes 116 so that the tube assembly may be pulled upwardly from the hole 91.

A flat disc-like bottom cover 118 closes the bottom ends of the hole 91 and slots 104 to prevent the epoxy cement 102 from flowing into the hole and slots before the cement hardens. The bottom cover 118 is secured to the bottom of the base member 90 by a set of studs (not shown) molded as an integral part of the base member and projecting downwardly through aligned holes 119 within the bottom cover. As shown in FIG. 6, a pair of diametrically opposed circular holes 122 are formed within the lower end portion of the tube 80, at 90° orientation to the pin 106, and sufficiently weaken the tube to define an area where the tube 80 bends in the event that the post is inadvertently impacted by a motor vehicle. As apparent from FIG. 7, the inner erecting tube 108 also bends with the outer tube 80 in the area of the holes 122 and cooperates to cause self-erection of the post 75 after it is bent and released.

From the drawings and the above description, it is apparent that a self-erecting post or roadway marking post constructed in accordance with the present invention, provides desirable features and advantages. The embodiment disclosed in FIGS. 1–3 is adapted to be quickly inserted into a hole formed within the ground or roadway bed, and the spring fingers 35 function to lock the lower end portion of the post into the ground and prevent the post from being pulled from the hole in response to one or more impacts by motor vehicles. The thermally deformed or flattened upper end portion 22 also provides for attaching a sheet of reflective material and aids in keeping the reflective sheet from being scraped from the tube 20 by the underneath surface of a motor vehicle. As also mentioned above, the tool 45 provides for quickly forming precise cylindrical holes within the ground or road bed so that the time required to install a post 15 is minimized. In addition, the tool 45 is economical in construction and may be used with any power operated impact hammer or may be manually driven into the ground which remains compacted.

The post 75 described in connection with FIGS. 6 and 7 may be quickly and positively attached to a roadway surface S by the adhesive 102 and is ideally suited for temporarily marking a roadway to channel traffic during construction. A series of posts 75 may also be installed on a permanent basis as lane dividers or to mark the boundaries of a roadway or traffic lane. The embodiment of FIGS. 6 and 7 also provides for conveniently and quickly removing the tube assembly from the base member 90 in the event that the tube assembly requires replacement or only the base member 90 is desired as a lane marker.

While the forms of posts herein described constitute preferred embodiments of the invention, it is to be understood that the invention is not limited to these precise forms of posts and to the specific hole forming tool disclosed, and that changes may be made therein without departing from the scope and spirit of the invention as defined in the appended claims.

The invention having thus been described, the following is claimed:

1. A self-erecting post adapted for marking a roadway, comprising an elongated flexible and collapsible tube of resilient plastics material and having an annular cross-sectional configuration, said tube having a lower portion adapted to project downwardly into a hole within the ground and an upper portion projecting substantially above the ground, said upper portion of said tube being capable of bending above the ground through an angle of ninety degrees in response to being accidentally impacted by a motor vehicle, a set of spring-like tube retaining members, said lower end portion of said tube having a hole for each said retaining member, said retaining members having lower end portions rigidly secured to the inner surface of said tube and projecting upwardly and outwardly through the corresponding said holes, said retaining members having upper end portions being engagable with the ground in response to inserting said lower portion of said tube into a hole within the ground, an elongated tubular erecting member of resilient flexible material, said erecting member extending within said upper portion of said tube and within said lower portion of said tube between said lower end portions of said retaining members, said erecting member having an intermediate portion disposed for bending with said tube when impacted by the motor vehicle, and said erecting member and the surrounding said tube being cooperatively effective to provide said post with a substantial number of self-erections in response to vehicle impacts on said post.

2. A self-erecting post as defined in claim 1 wherein said erecting member comprises a tube of semi-rigid plastics material.

3. A self-erecting post as defined in claim 1 wherein said upper portion of said tube includes an inwardly deformed flattened upper end section, and a panel of reflecting material secured to the outer surface of said upper end section.

4. A self-erecting post as defined in claim 3 and including an elongated generally oval closure member covering the top end of said tube.

5. A self-erecting post as defined in claim 1 wherein said tube defines at least one opening within said intermediate portion to weaken the tube for bending adjacent the opening.

6. A self-erecting post adapted for use along a roadway, comprising an elongated flexible and collapsible tube of resilient plastics material and having an annular cross-sectional configuration, said tube having a lower end portion and an upper portion, said upper portion of said tube being capable of bending through an angle of ninety degrees in response to being accidentally impacted by a motor vehicle, a base member having a generally flat bottom surface adapted to be attached by adhesive to a roadway surface, said base member defining an opening for receiving said lower end portion of said tube, a mounting pin extending laterally through said lower end portion of said tube and having at least one end portion projecting radially outwardly from said tube, said base member defining a generally vertical slot projecting outwardly from said opening for receiving said end portion of said mounting pin, and a retractable locking pin extending laterally through said base member and said slot above said end portion of said mounting pin for positively securing said collapsible tube to said base member.

7. A self-erecting post as defined in claim 6 wherein said mounting pin has an opposite end portion also projecting radially outwardly from said tube, said base member defines a second said slot for receiving said opposite end portion of said mounting pin, and a second said retractable locking pin extends laterally through said base member and said second slot above said opposite end portion of said mounting pin.

8. A self-erecting post as defined in claim 6 wherein said base member comprises a molded plastics material and defines generally concentric grooves within said bottom surface, and each of said grooves has a depth greater than its width for receiving the adhesive and to obtain a positive bond of the adhesive to said base member.

9. A self-erecting post as defined in claim 1 and including a generally cylindrical erecting member within said tube, a cylindrical spacing sleeve disposed between said tube and said tubular erecting member, and at least one fastener rigidly connecting said tube, said sleeve and said erecting member.

* * * * *